US008800812B2

(12) United States Patent
Lin et al.

(10) Patent No.: US 8,800,812 B2
(45) Date of Patent: Aug. 12, 2014

(54) HOLDING APPARATUS

(75) Inventors: Wan-Cheng Lin, New Taipei (TW); Zhong-Qun Li, Shenzhen (CN); Zhong-Liang Jian, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 452 days.

(21) Appl. No.: 13/171,277

(22) Filed: Jun. 28, 2011

(65) Prior Publication Data

US 2012/0119636 A1 May 17, 2012

(30) Foreign Application Priority Data

Nov. 12, 2010 (CN) ..... 2010 1 0541560

(51) Int. Cl.
*B65H 1/00* (2006.01)

(52) U.S. Cl.
USPC ..... 221/197

(58) Field of Classification Search
USPC ..... 220/23.88, 480, 241, 242, 601; 221/76, 221/82, 197, 102, 282; 361/810; 438/64; 414/288, 808, 812; 42/50; 222/185.1; 248/174, 231.9, 128, 146; 312/42, 45, 312/49, 72, 73; 229/122.1, 125.12
See application file for complete search history.

(56) References Cited

U.S. PATENT DOCUMENTS

| | | | | | |
|---|---|---|---|---|---|
| 2,868,360 | A | * | 1/1959 | Donkin | 206/3 |
| 3,191,810 | A | * | 6/1965 | Johnston | 222/183 |
| 3,854,232 | A | * | 12/1974 | Musgrave | 42/87 |
| 3,887,106 | A | * | 6/1975 | Charlson et al. | 221/197 |
| 5,476,190 | A | * | 12/1995 | Herrmann et al. | 221/197 |
| 5,588,555 | A | * | 12/1996 | Kanamori et al. | 221/197 |

* cited by examiner

*Primary Examiner* — Joshua Rodden
*Assistant Examiner* — James Twomey
(74) *Attorney, Agent, or Firm* — Novak Druce Connolly Bove + Quigg LLP

(57) ABSTRACT

A holding apparatus includes a bracket and a receiving case. The receiving case is mounted to the bracket and receives a plurality of products. In addition includes a front wall, a rear wall opposite to the front wall, a bottom wall connected to the rear wall, two opposite sidewalls connected to the front wall, rear wall and the bottom wall. The front wall defines a through hole, and the through hole extends to the bottom wall. An acute angle is defined between the bottom wall and the front wall.

17 Claims, 7 Drawing Sheets

HOLDING APPARATUS

BACKGROUND

1. Technical Field

The present disclosure relates to a holding apparatus.

2. Description of Related Art

A receiving case is adapted to receive a plurality of products from production equipment. The products are retrieved from the receiving case by a packaging device for being packaged. Usually, the receiving case defines an opening. The products are received into the receiving case through the opening, and retrieved from the receiving case through the same opening by inclining the receiving case. This is a laborious and time consuming method. Therefore, there is room for improvement in the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 3:
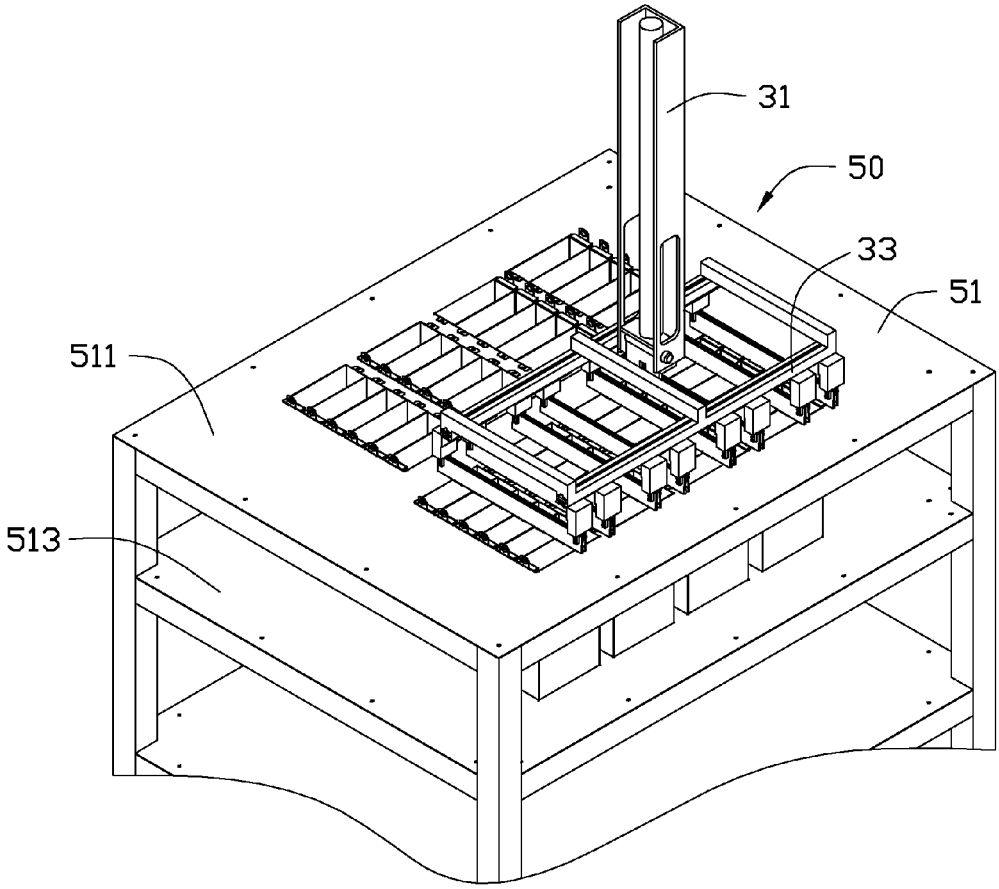
FIG. 3 is similar to FIG. 1, but showing the controller moving the products to the holding apparatus.
Figure 4:
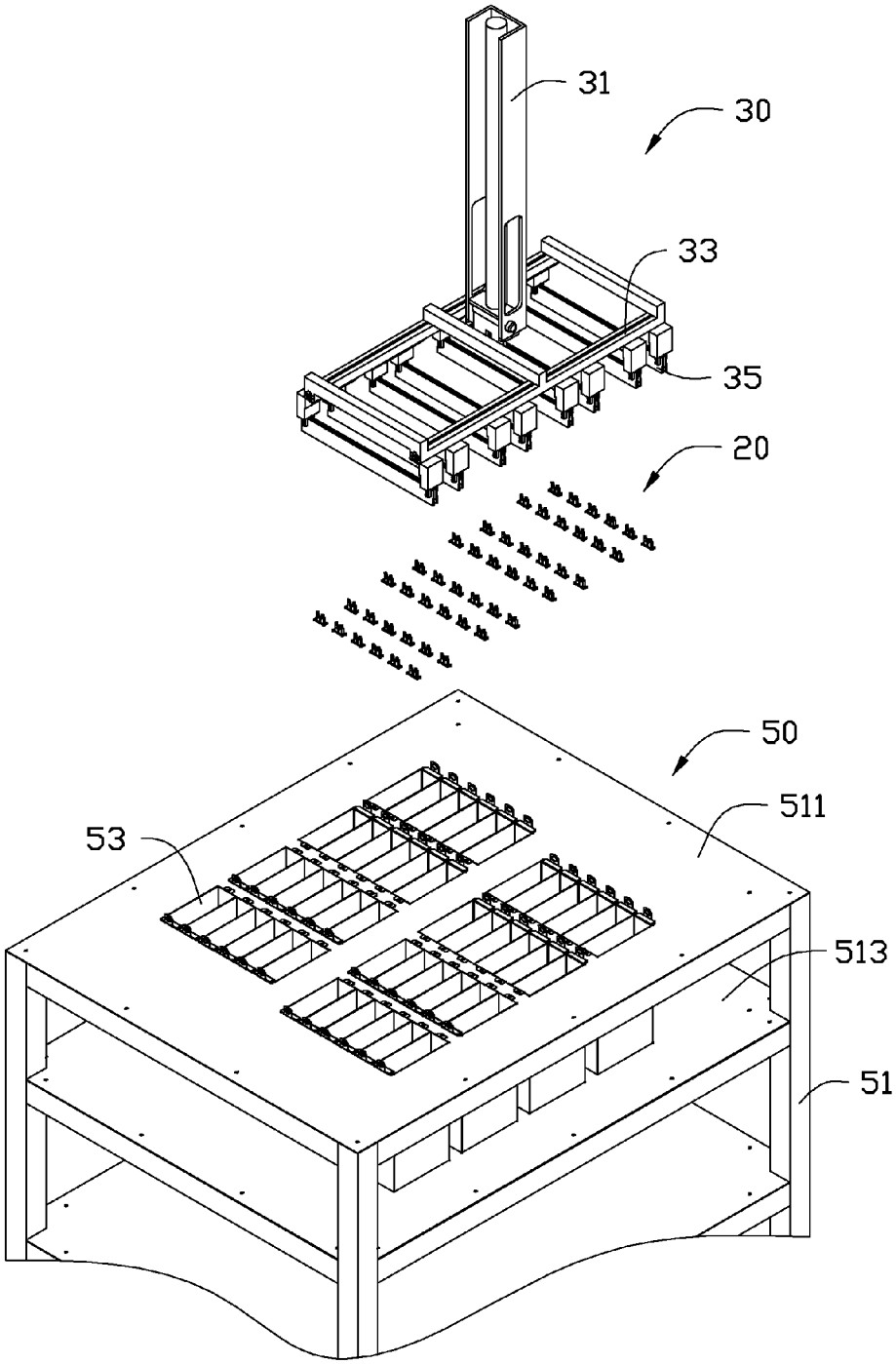
FIG. 4 is an exploded, isometric view of FIG. 3.

Referring to FIG. 3-4, a holding apparatus 50 in accordance with an embodiment includes a bracket 51 and a plurality of receiving cases 53 mounted to the bracket 51.

The bracket 51 includes a top plate 511 and a bottom plate 513 that is substantially parallel to the top plate 511. The top plate 511 defines a plurality of first openings (not labeled), and the bottom plate 513 defines a plurality of second openings (not labeled) corresponding to the first openings. Each first opening and the corresponding one second opening are capable of receiving one of the receiving cases 53.

Figure 5:
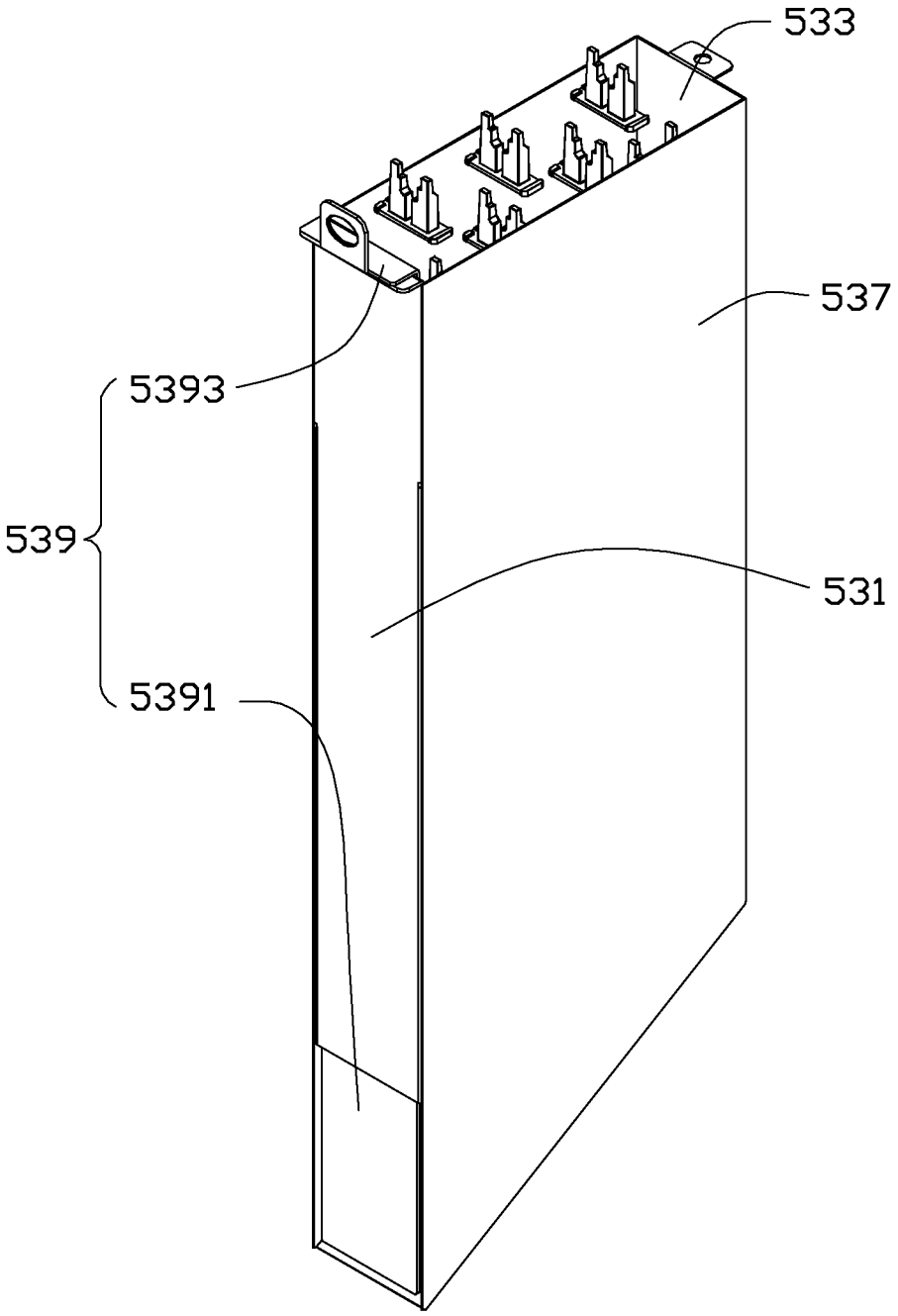
FIG. 5 is an isometric view of a receiving case of FIG. 4, and showing a sliding board in a closed position.
Figure 6:
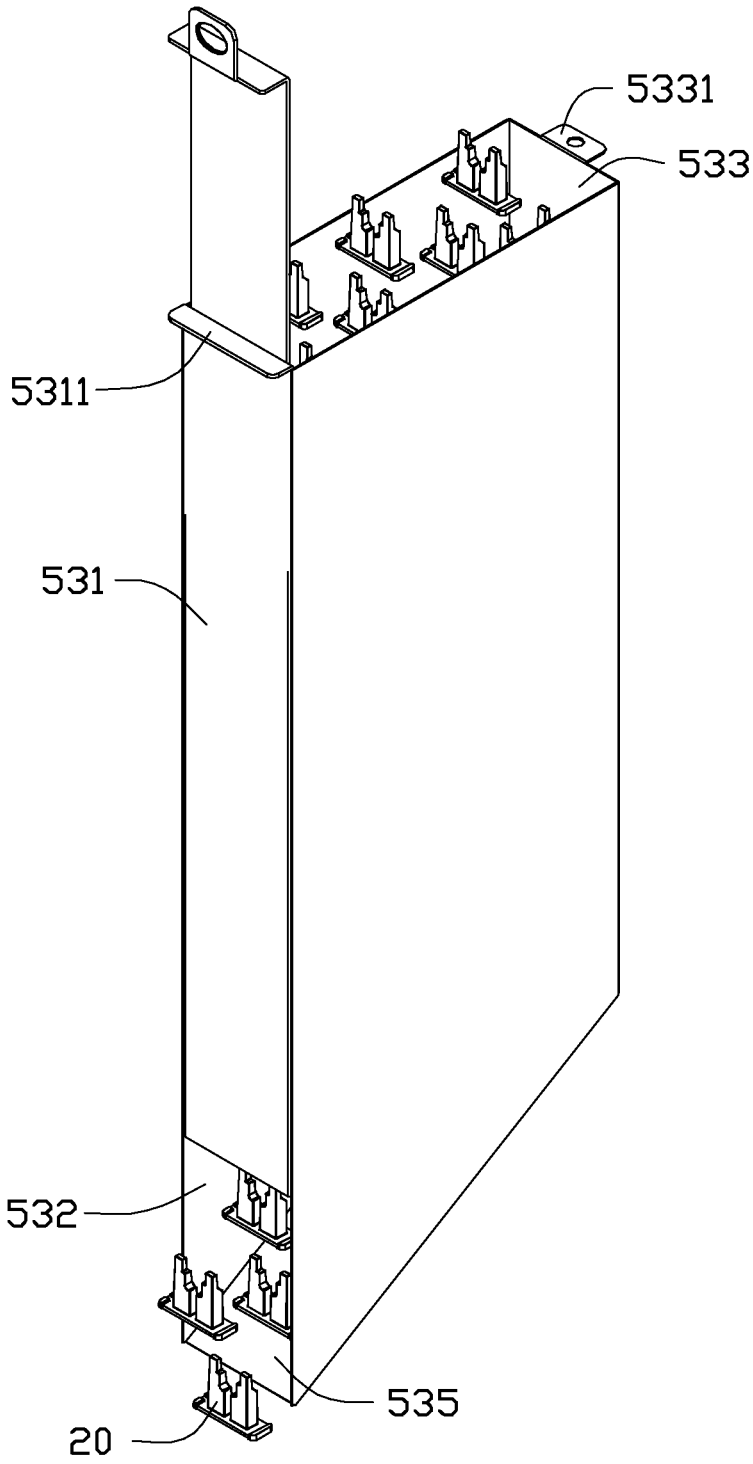
FIG. 6 is similar to FIG. 5, but showing the receiving case in an open position.
Figure 7:
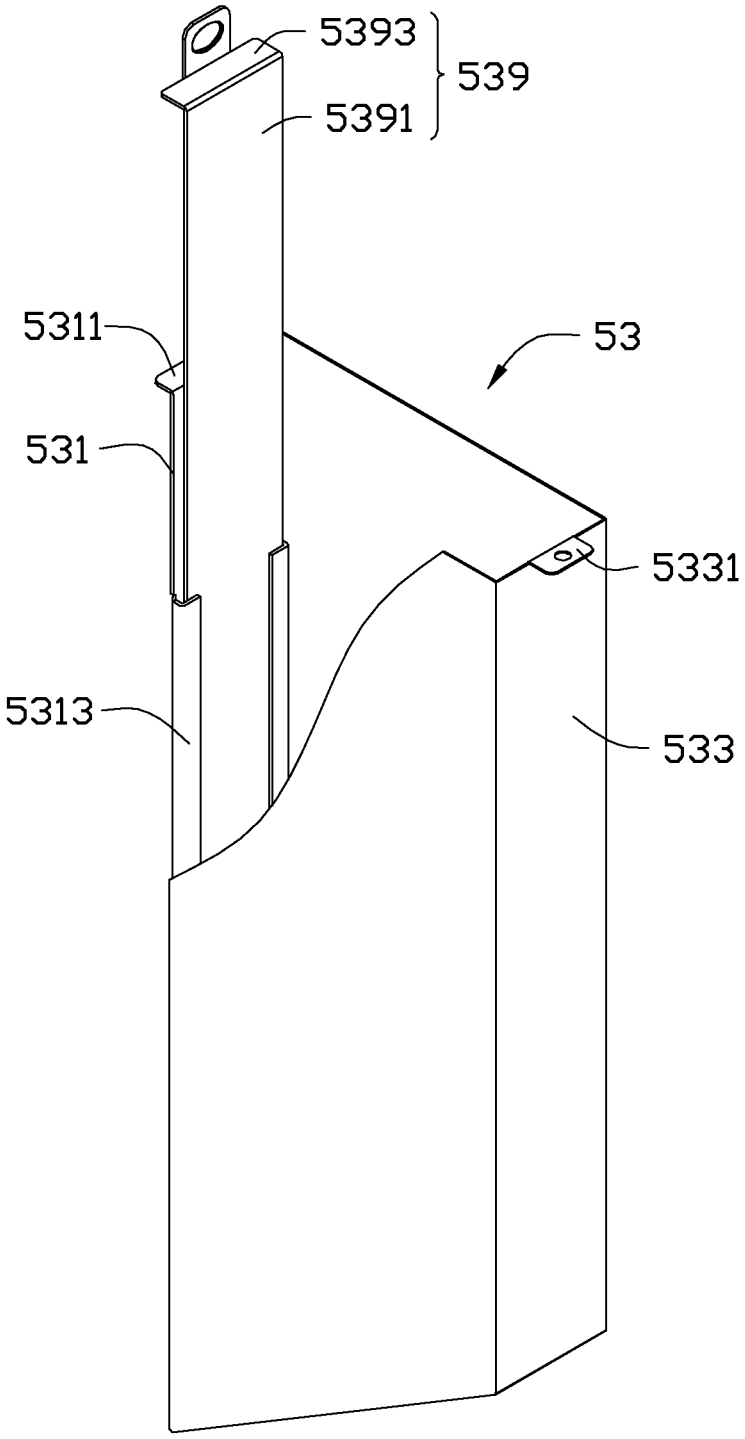
FIG. 7 is an isometric, cutaway view of the receiving case.

Referring to FIGS. 5-7, each receiving case 53, receiving a plurality of products 20, includes a front wall 531, a rear wall 533, a bottom wall 535 and two opposite sidewalls 537. In one embodiment, the front wall 531 is substantially parallel to the rear wall 533 and perpendicular to the sidewalls 537. The front wall 531, the rear wall 533, the bottom wall 535 and the two sidewalls 537 define a receiving space. A first positioning piece 5311 extends from a top edge of the front wall 531, and a limiting portion 5313 extends from each of two opposite side edges of the front wall 531. In one embodiment, the limiting portion 5313 is substantially L-shaped. A gap (not shown) is defined between the limiting portions 5313 and the front wall 531. A through hole 532 is defined in the front wall 531 and extends to the bottom wall 535 and the two sidewalls 537. A second positioning piece 5331 extends from the rear wall 533. In one embodiment, the first positioning piece 5311 and the second positioning piece 5331 are substantially located on the same plane. The bottom wall 535 is obliquely planar relative to the front wall 531. A first angle, defined between the bottom wall 535 and the front wall 531, is acute. A second angle, defined between the bottom wall 535 and the rear wall 533, is obtuse.

Each receiving case 53 further includes a sliding board 539. The sliding board 539 includes a body 5391 and a controlling portion 5393 extending from a top edge of the body 5391. The body 5391 is received in the gap and is slidable relative to the front wall 531. The sliding board 539 is slidable between a closed position and an open position. In the closed position, the sliding board 539 covers the through hole 532 and abuts the bottom wall 535, to prevent the products 20 from sliding out of the receiving case 53 through the through hole 532, and the controlling portion 5393 abuts the first positioning piece 5311 of the front wall 531. In the open position, the body 5391 slides upwardly to expose the through hole 532, so that the products 20 are capable of sliding out of the receiving case 53 through the through hole 532; the body 5391 is disengaged from the front wall 531, and the controlling portion 5393 is disengaged from the first positioning piece 5311.

In assembly, the receiving case 53 is located in the first opening of the top plate 511 and the second opening of the bottom plate 513, the first positioning piece 5311 and the second positioning piece 5331 abut the top plate 511.

Figure 1:
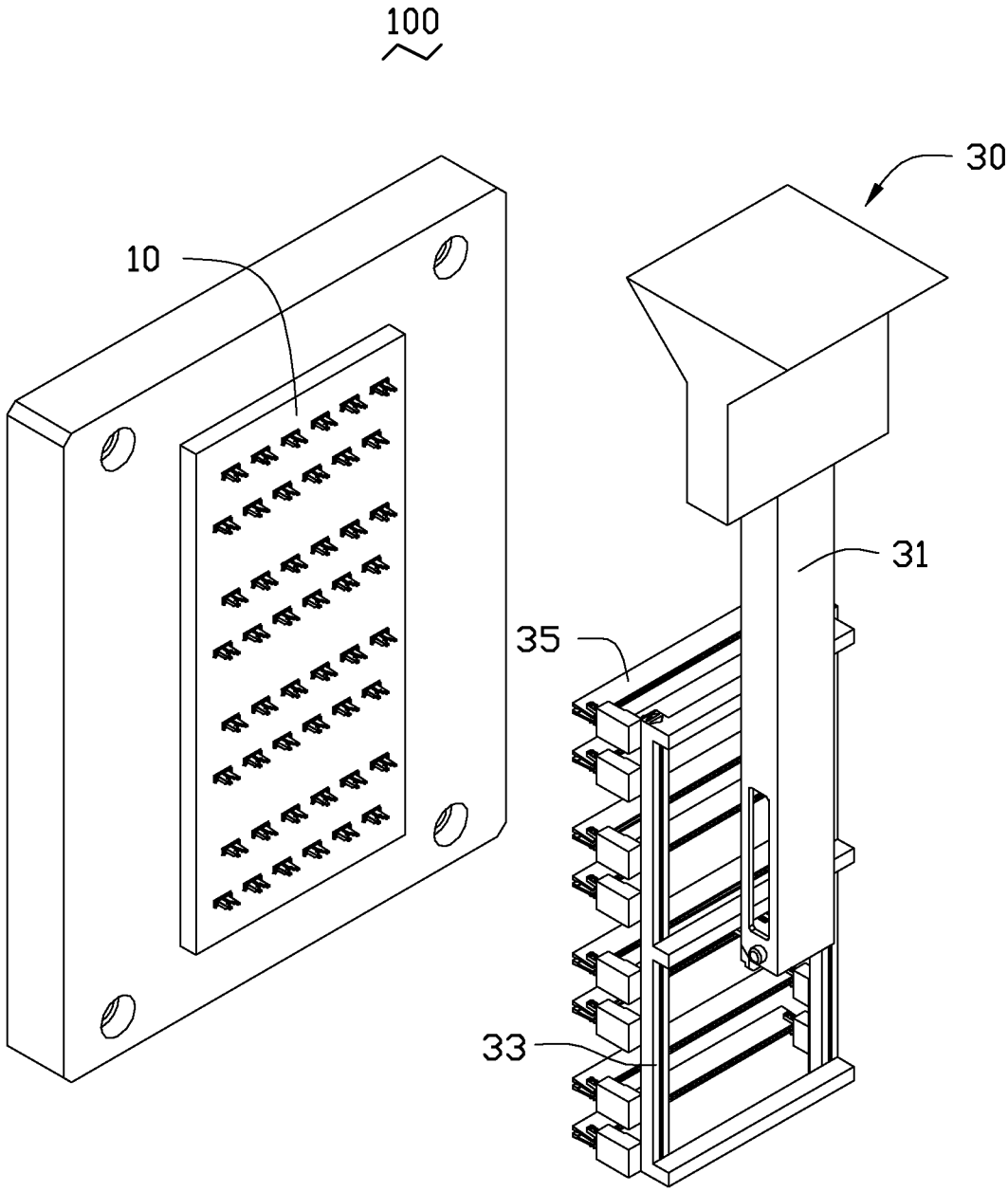
FIG. 1 is an exploded, isometric view of a mold and a controller of a holding apparatus in accordance with an embodiment.
Figure 2:
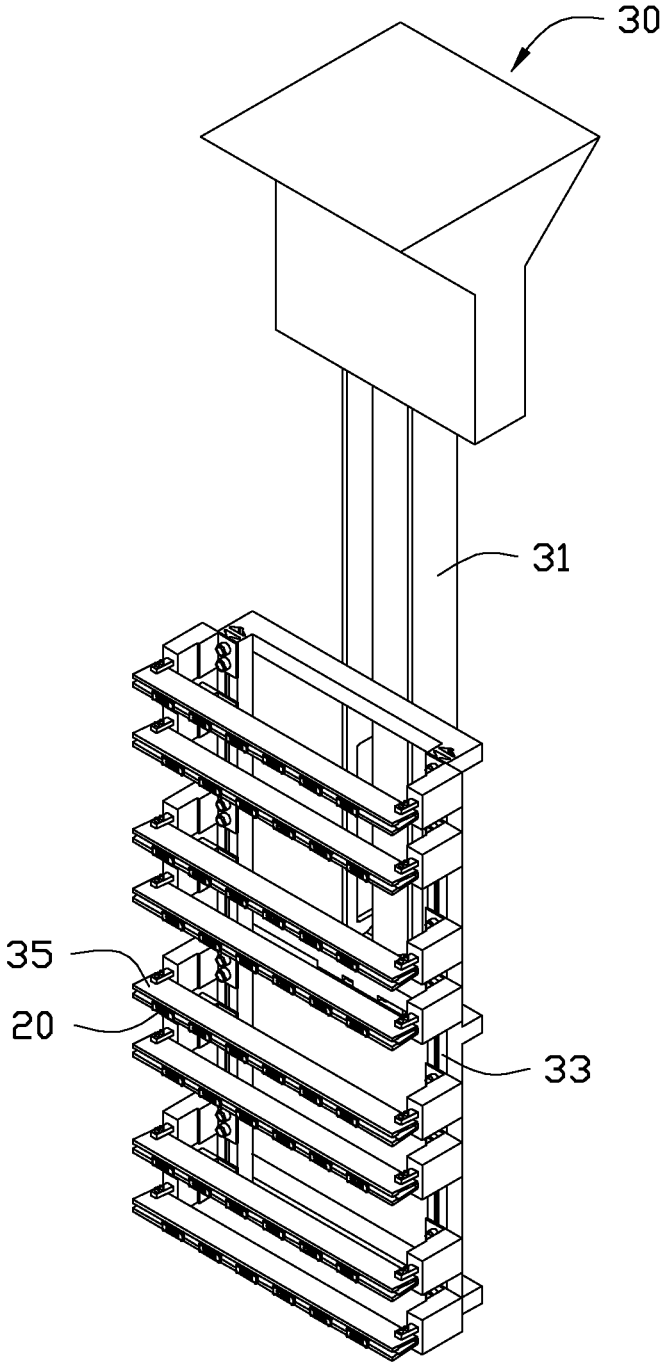
FIG. 2 is an isometric view of the controller and a plurality of products of FIG. 1.

Referring to FIG. 1 and FIG. 2, the holding apparatus is capable of being used in production equipment 100. The production equipment 100 includes a mold 10 and a controller 30. The production equipment 100 produces the products 20. The controller 30 includes a holding arm 31 and a rotatable frame 33. A plurality pairs of splints 35 is secured to the rotatable frame 33. Each pair of splints 35 clamps the products 20.

Referring to FIGS. 1-4, in use, the sliding board 539 of the receiving cases 53 is located in the closed position initially. The splints 35 clamp the products 20 from the mold 10, and then the rotatable frame 33 rotates relative to the controller 30, until the rotatable frame 33 is substantially perpendicular to the holding arm 31. The rotatable frame 33 is moved to above the bracket 51 by the controller 30. Then, the rotatable frame 33 is substantially parallel to the top plate 511, and each product 20 corresponds to one of the plurality of receiving cases 53. The controller 30 drives the splints 35 to release the products 20. Each product 20 is dropped into the corresponding receiving case 53. The rotatable frame 33 is moved to the initial position by the controller 30, for clamping other products produced by the mold 10.

When the receiving case 53 is filled with the products 20, the controlling portion 5393 is pulled upward to slide the sliding board 539, until the sliding board 539 is located in the open position. At this time, because the bottom wall 535 of the receiving case 53 is an oblique angle, a acute angle is defined between the receiving case 53 and the front wall 531, and the products 20 are slid out of the receiving case 53 through the through hole 532 along the bottom wall 535. Then, the products 20 are dropped into a packaging device (not shown) below each receiving case 53.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A holding apparatus comprising:

a bracket; and a receiving case, mounted to the bracket and adapted to receive a plurality of products, comprising a front wall and a sliding board, and defining a through hole; the front wall defining a gap, and the sliding board is received in the gap and slidably attached to the front wall and comprises a controlling portion extending out of the receiving case;

wherein the receiving case further comprises a first positioning piece extending from the front wall and abutting a top surface of the bracket; the sliding board is slidable between a closed position, where the controlling portion abuts the first positioning piece, and the sliding board covers the through hole, and an open position, where the controlling portion disengages from the first positioning piece, and the sliding board opens the through hole.

2. The holding apparatus of claim 1, wherein the receiving case further comprises a rear wall opposite to the front wall, a bottom wall connected to the rear wall, and two opposite sidewalls connected to the front wall, the rear wall and the bottom wall; the sliding board abuts the bottom wall when the sliding board is located in the closed position; and the sliding board is disengaged from the bottom wall when the sliding board is located in the open position.

3. The holding apparatus of claim 2, wherein the through hole is defined in the front wall and extends to the bottom wall, and the through hole is adapted to slide the plurality of products out of the receiving case.

4. The holding apparatus of claim 1, wherein a limiting portion extends from a side edge of the front wall, and the gap is defined between the limiting portion and the front wall.

5. The holding apparatus of claim 1, wherein the sliding board further comprises a body, and the controlling portion extends substantially perpendicularly from the body.

6. The holding apparatus of claim 5, wherein the body is received in the gap and slidable relative to the front wall.

7. The holding apparatus of claim 2, wherein a second positioning piece extends from the rear wall, and the second positioning piece abuts the bracket.

8. The holding apparatus of claim 2, wherein an angle is defined between the bottom wall and the front wall, and the angle is acute.

9. The holding apparatus of claim 2, wherein an angle is defined between the bottom wall and the rear wall, and the angle is obtuse.

10. A holding apparatus comprising:

a bracket; and a receiving case, mounted to the bracket, comprising a front wall, a rear wall opposite to the front wall, a bottom wall connected to the rear wall, two opposite sidewalls connected to the front wall, the rear wall and the bottom wall, and a sliding board slidably attached to the front wall and comprising a controlling portion extending out of the receiving case;

wherein the front wall defines a through hole, and the through hole extends to the bottom wall; the receiving case further comprises a first positioning piece extending from the front wall and abutting a top surface of the bracket; the sliding board is slidable between a closed position, where the controlling portion abuts the first positioning piece, and the sliding board covers the through hole, and an open position, where the controlling portion disengages from the first positioning piece, and the sliding board opens the through hole; and a first angle is defined between the bottom wall and the front wall, and the first angle is acute.

11. The holding apparatus of claim 10, wherein the front wall defines a gap, and the sliding board is slidably received in the gap.

12. The holding apparatus of claim 11, wherein a limiting portion extends from a side edge of the front wall, the limiting portion is substantially "L" shaped, and the gap is defined between the limiting portion and the front wall.

13. The holding apparatus of claim 11, wherein the sliding board further comprises a body, and the controlling portion extends substantially perpendicularly from the body.

14. The holding apparatus of claim 13, wherein the body is received in the gap and is slidable relative to the front wall by pulling the controlling portion.

15. The holding apparatus of claim 10, wherein a second positioning piece extends from the rear wall, and the second positioning piece abuts the bracket.

16. The holding apparatus of claim 10, wherein a second angle is defined between the bottom wall and the rear wall, and the second angle is obtuse.

17. The holding apparatus of claim 10, wherein the sliding board abuts the bottom wall when the sliding board is located in the closed position; and the sliding board is disengaged from the bottom wall when the sliding board is located in the open position.

* * * * *